US006615436B1

(12) United States Patent
Burch, Jr. et al.

(10) Patent No.: US 6,615,436 B1
(45) Date of Patent: Sep. 9, 2003

(54) POWERED DRAIN CLEANER

(75) Inventors: Danny L. Burch, Jr., Elyria, OH (US); Michael J. Rutkowski, Brunswick, OH (US); Jon R. Dunkin, Elyria, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/659,410

(22) Filed: Sep. 11, 2000

(51) Int. Cl.[7] ..... B08B 9/02
(52) U.S. Cl. ..... 15/104.33; 15/104.05
(58) Field of Search ..... 15/104.33, 104.05

(56) References Cited

U.S. PATENT DOCUMENTS 2,284,939 A 6/1942 Asnard
4,317,247 A * 3/1982 Levine ..... 15/104.33
4,956,889 A * 9/1990 Kirk ..... 15/104.33
5,265,301 A * 11/1993 Irwin ..... 15/104.33
5,414,888 A * 5/1995 Irwin ..... 15/104.33
5,901,401 A * 5/1999 Rutkowski et al. ..... 15/104.33
5,987,684 A * 11/1999 Evans ..... 15/104.33
6,158,076 A * 12/2000 Rutkowski et al. ..... 15/104.33
6,470,525 B1 * 10/2002 Silverman ..... 15/104.33

* cited by examiner

*Primary Examiner*—Robert J. Warden, Sr.
*Assistant Examiner*—S Balsis
(74) *Attorney, Agent, or Firm*—Fay, Sharpe, Fagan, Minnich & McKee

(57) ABSTRACT

A hand held drain cleaning tool including a drain cleaning cable coiled in a drum and having a support for holding the drum in one hand while rotating the drum with a hand held crank or a power operated drive. The crank and power operated drive are releasably connected to the drum so as to be interchangeable. The drain cleaning tool also includes a vibration dampener to reduce the vibrations caused by the rotating drum, especially at high rotation speeds.

27 Claims, 4 Drawing Sheets

POWERED DRAIN CLEANER

INCORPORATION BY REFERENCE

U.S. patent application Ser. No. 09/253,923, filed Feb. 22, 1999, now U.S. Pat. No. 6,158,076, and U.S. Pat. No. 2,284,939 are incorporated herein by reference to illustrate and disclose prior art hand held and hand operated drain cleaning tools. The general features of these hand held and hand operated drain cleaning tools can be used in combination with the present invention, thus are incorporated herein by reference so that such components need not be fully described herein.

This invention relates to the art of drain cleaning tools and, more particularly, to cable feeding devices for powered and/or hand held and hand operated drain cleaning tools.

BACKGROUND OF THE INVENTION

Hand held and hand operated drain cleaning tools have been provided heretofore and generally, as shown in U.S. Pat. No. 6,158,076 and U.S. Pat. No. 2,284,939 for example, are comprised of a drain cleaning cable or snake coiled in a cable drum which is rotatable relative to a support by which the drum is adapted to be held in one hand of a user while the latter rotates the drum with his or her other hand through a crank on the drum. The cable extends forwardly of the drum and is extended relative thereto for insertion into a drain to be cleaned and rotates with the drum so as to clear a blockage encountered in the drain. Further in this respect, as disclosed in U.S. Pat. No. 2,284,939, a length of the cable is adapted to be manually withdrawn from the drum by the user, and then a thumb screw is tightened against the cable at the forward end of the drum so as to preclude unintended displacement of the cable into the drum as the cable is advanced into the drain to be cleaned. The drum is then held with one hand and rotated by the other while the user at the same time forces the cable into the drain. When the withdrawn length of the cable has been inserted into the drain, the thumb screw is loosened, the cable is held in place and the drum is withdrawn from the entrance to the drain to withdraw a further length of cable from the drum. The thumb screw is again tightened and the operation is repeated to displace the newly extended length of the cable to the drain. In U.S. Pat. No. 2,284,939, the hand support for holding the drum for rotation is a tubular support at the rear end of the drum and, in other previous support arrangements, such a tubular support is disposed forwardly of the drum and may include a pistol grip type handle extending laterally of the axis of rotation for supporting the drum. A hand held and hand operated tool of the latter structure is available from The Ridge Tool Company of Elyria, Ohio under the latter's product designation "K-Spin Hand Spinner." When the drain cleaning operation is completed, the thumb screw is loosened and the cable is manually pushed back into the drum by the user.

Hand held and hand operated drain cleaning tools of the foregoing character are desirable in that they are lightweight, structurally simple, economical to manufacture, and, for all of these reasons, ideal for use in connection with light duty drain cleaning operations such as those encountered in a residential home. At the same time, the necessity to manually extend and retract the cable relative to the drum, and to tighten and loosen the thumb screw in connection with inserting and rotating the cable relative to a drain to be cleaned is cumbersome, difficult at times, such as in connection with moving the leading end of the cable around a sharp bend in the drain line, and is dirty as a result of sludge and other material adhering to the cable and contacting the hand of the user in connection with extending and retracting the cable relative to the drum. Should the user of the tool encounter an obstruction in the drain line while a considerable length of the cable extends outwardly from the drain entrance, rotation of the cable can result in the latter whipping about the axis of the drain as opposed to rotating about its own axis, and such whipping can damage the area adjacent the drain entrance. Further, it becomes frustrating, awkward and difficult in such situations to loosen the thumb screw to retract the extra cable into the drum without pulling the cable from the drain, tightening the thumb screw and then pushing and rotating the drum in an effort to advance the snake. Further frustration results from having to repeat the thumb screw loosening, cable pulling, thumb screw tightening, and drum pushing and rotating procedure, in order to move the leading end of the cable through or past the obstruction. While the foregoing problems and difficulties are minimized or avoided in connection with the operation of motor powered drain cleaning apparatus by providing the latter with cable feeding mechanisms operable in response to rotation of the drum and cable to automatically feed the latter relative to the drum, such feeding devices heretofore available are structurally complex, expensive, structurally and/or functionally complicated and/or inoperable in connection with a hand held and hand operated drain cleaning tool in which the drum is supported by one hand of a user and rotated by the other.

The hand held and hand operated drain cleaning tool disclosed in U.S. Pat. No. 6,158,076 overcomes these problems. The hand held and hand operated drain cleaning tool includes cable driving components mounted on the drum support and a manually operated drive actuator mounted on the drum support for selective displacement by the user between operating and non-operating conditions relative to the cable for respectively feeding the cable relative to the drum and interrupting the cable feed.

Although this new hand held and hand operated device overcomes many of the problems associated with prior hand held and hand operated devices, there are instances when it is difficult to operate the hand held and hand operated device due to the length of cable that has been fed out and/or the type of clog encountered. During such operations, a power operated drain cleaning tool is desirable. However, in many situations the hand held and hand operated device is sufficient to accomplish the job. Therefore, there is a need for a drain cleaning tool that can be operated both manually or powered means and can be conveniently modified for operation by hand or by a power operated drive.

SUMMARY OF THE INVENTION

In accordance with the present invention, feeding arrangements are provided for drain cleaning tools of the foregoing character which avoid or minimize the problems and difficulties encountered in connection with the use thereof and which provide the advantages realized in connection with the use of cable feeding devices with power driven drain cleaning apparatus while promoting and maintaining the desired simplicity of structure and economy of manufacture and ease of use of a hand held and hand operated drain cleaning tool. In addition, the drain cleaning tool is easily modifiable into a power driven drain cleaning tool when added torque and speed are required. Feeding devices according to the invention include cable driving components mounted on the drum support and a manually or power operated drive actuator mounted on the drum support for selective displacement by the user between operating and non-operating conditions relative to the cable for respectively feeding the cable relative to the drum and interrupting the cable feed. Importantly, the manually or power operable drive actuator is positioned for operative displacement by the user using the fingers of the one hand by which the drum is supported while the drum is being rotated by the other hand of the user or the hand operating the power operated drive. In accordance with one embodiment, the drum support includes a hand grip by which the drum is supported with the one hand of the user, and the drive actuator includes a trigger forwardly adjacent the hand grip which is selectively displaceable by the user while he or she supports the drum in the one hand and rotates the drum with the other or operates a power drive to rotate the drum. In accordance with another embodiment, the drum support includes a cradle-like portion extending forwardly of the drum and by which the latter is adapted to be supported by one hand of a user, and the manually or power operable drive actuator is diametrically opposed to the cradle-like portion and is selectively displaceable by the fingers and/or thumb of the one hand of the user while the latter rotates the drum with his or her other hand to operate a power drive to rotate the drum. In this embodiment, the cradle and drive actuator components structurally provide a tubular configuration in which the parts are adapted to be radially constricted in response to a squeezing type gripping of the components.

Advantageously, a feeding device in accordance with the present invention comprises three feed rollers and one drive actuator, thus minimizing the number of component parts, and maintaining a desired lightweight and economical cost of production while improving the ease and convenience of use heretofore experienced with hand held and hand operated or power operated drain cleaning tools by eliminating the need to manually displace the cable relative to the drum in connection with the performance of a drain cleaning operation.

In accordance with another aspect of the present invention, the drain cleaning tool includes a handle that rotates the drum which is removable and/or can be used in association with a power operated drive. The power operated drive can provide additional torque and speed to the drum to rotate the drum in various circumstances. The power operated drive can be an electrical or a gas operated drive One particular power drive that is well suited for use with the drain cleaner is an electric power drill. The electric power drill is commonly available, easy to operate, and relatively lightweight. Battery operated power drills provide added flexibility for use in locations not readily accessible to a power outlet. In one embodiment, the handle includes an opening which allows a power operated drive to be connected to. a drive rod to rotate the drum. The power operated drive, when connected to the drive rod, causes the drive rod and the handle to rotate when rotating the drum. In one aspect of this embodiment, the opening in the handle is aligned with the longitudinal axis of the drive rod. In another aspect of this embodiment, the opening in the handle is positioned on the back surface of the handle. In another embodiment, the handle is removable to allow the power operated drive to be connected to the drive rod. By removing the handle, the inconvenience associated with the handle rotating while the power operated drive rotates the drum is eliminated. Such inconveniences include visual distractions caused by the rapid rotation of the handle; handle damage caused by the handle rapidly rotating that could strike an adjacently positioned object; and excessive noise, vibrations and/or instability caused by the non-symmetry, shape and size of the handle rapidly rotating about the axis of rotation of the drive rod. In one aspect of this embodiment, the handle includes a quick connection and/or disconnection arrangement to enable an operator to quickly and easily connect and/or disconnect the handle from the drive rod. Such arrangement can include, but is not limited to, snap clips on the handle and/or handle mount, a lock slot arrangement on the handle and/or handle mount, a quick release latch on the handle and/or handle mount, spring locks on the handle and/or handle mount, and/or lock pins on the handle and/or handle mount. The quick connection and/or disconnection arrangement enables an operator to remove and/or connect the handle to the drive rod without the need for tools. As can be appreciated, the handle can be connected to the drive rod by screws, bolts and the like which only require standard tools. The same can be applied for removing the handle.

In accordance with still another embodiment of the invention, a vibration dampening mechanism is secured to the drive rod of the drum to reduce vibrations during the rotation of the drum. When the drum is rotated, especially at high speeds, a significant amount of vibration can be generated. As a result of this vibration, the drum of the drain cleaner may not be able to be operated at high speeds due to the uncomfortable vibrations produced during the operation and handling of the drain cleaner. These vibrations are commonly the result of the cable wound about the drum and being wound symmetrically about the central axis of the drum, the rotation of a manually operated handle when used in conjunction with a power operated drive, and/or the twisting action of the cable in a drain pipe. The vibration dampening mechanism is designed to isolate the vibrations thereby reducing or eliminating the amount of vibration transferred to the manual handle or power operated drive, thus allowing the drum to be rotated at significantly greater speeds. In one embodiment, the vibration dampening mechanism is positioned adjacent to the coupling region of the manual handle and/or power operated drive to the drive rod of the drum. When a power operated drive is connected to the drive rod, the vibrations generated during the rotation of the drum are transferred through the drive rod to the power operated drive. By positioning the vibration dampening mechanism adjacent to the coupling region, the amount of vibration transferred to the power operated drive is significantly reduced. In one aspect of this embodiment, the vibration dampening mechanism is at least partially positioned about the drive rod. In another embodiment, the vibration dampening mechanism includes a spring designed to absorb vibrations generated during the rotation of the drum. The spring can be, but is not limited to, a coil spring. Typically, the spring is positioned about the longitudinal axis of the drive rod. In still another embodiment, the vibration dampening mechanism includes a rubber and/or elastomer washer, a flexible drive rod, belleville washers and the like.

It is accordingly an outstanding object of the present invention to provide a hand held and hand operated and/or power operated drain cleaning tool with a cable feeding device for axially displacing a drain cleaning cable relative to the storage drum thereof in response to rotation of the drum as the latter is supported by one hand of a user and rotated by the user's other hand or by a power operated drive.

Another object of the present invention is the provision of a cable feeding device for a drain cleaning tool of the foregoing character which is selectively operable by the user of the tool in conjunction with the latter's support of the tool during use thereof to engage and feed the cable or to release the cable for rotation with the cable drum without axial displacement.

Still another object of the present invention is the provision of a cable feeding device for a drain cleaning tool of the foregoing character which promotes maintaining a lightweight characteristic of the tool and the ease and convenience of use thereof while eliminating the need to manually displace the cable relative to the tool drum in order to perform a drain cleaning operation therewith.

A further object of the present invention is the provision of a cable feeding device for a drain cleaning tool of the foregoing character which is comprised of a minimum number of parts and is structurally simple, thereby promoting maintaining the economical production characteristic of the tool.

Yet a further object of the present invention is the provision of a cable feeding device for a drain cleaning tool of the foregoing character, wherein the manual handle for rotating the storage drum is easily connectable and disconnectable to the drive rod so that a power operated drive can be connected to the drive rod to rotate the storage drum.

Still yet another object of the present invention is the provision of a cable feeding device for a drain cleaning tool of the foregoing character which includes a vibration reducing mechanism that isolates vibrations from being transferred to the manual rotating handle and/or power operated drive during the rotation of the storage drum.

BRIEF DESCRIPTION OF THE DRAWINGS

The foregoing objects, and others, will in part be obvious and in part be pointed out more fully hereinafter in conjunction with the written description of preferred embodiments of the invention illustrated in the accompanying drawings in which.

DESCRIPTION OF PREFERRED EMBODIMENTS

Figure 1:
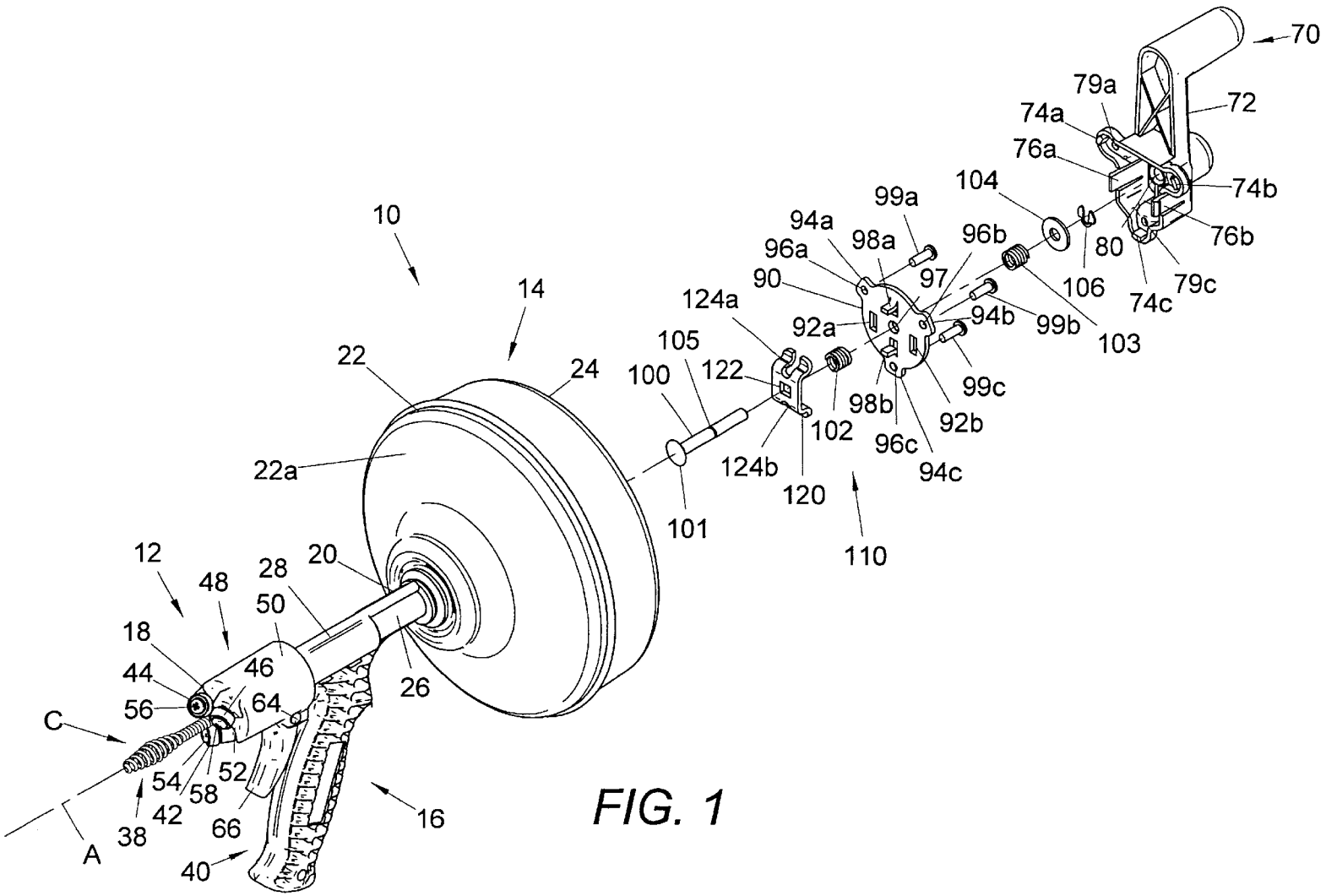
FIG. 1 is an exploded perspective view of the vibration dampening arrangement and handle connection arrangement of the present invention.
Figure 2:
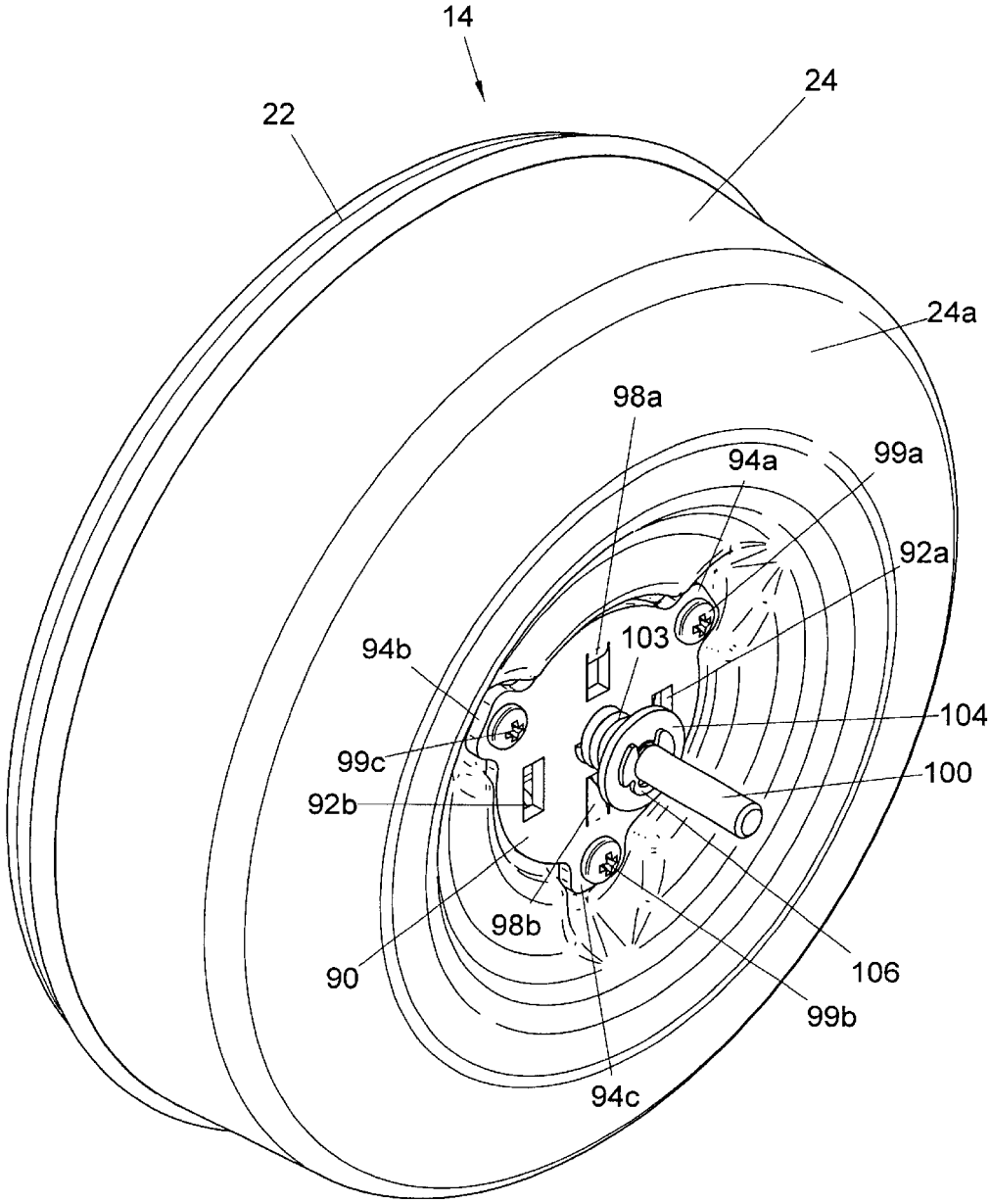
FIG. 2 is a rear elevation view of the assembled vibration dampening arrangement shown in FIG. 1.

Referring now in greater detail to the drawings, wherein the showings are for the purpose of illustrating preferred embodiments of the invention only, and not for the purpose of limiting the same, FIGS. 1 and 2 of the drawings illustrate a drain cleaning tool 10 having a cable feeding device 12 mounted thereon for selectively displacing a drain cleaning cable C relative to tool 10 and into and out of a drain to be cleaned. Drain cleaning tool 10 comprises a cable drum 14 and a drum support 16 having front and rear ends 18 and 20, respectively. Drum 14 is at rear end 20 of support 16 and comprises front and rear drum portions 22 and 24, respectively, of a suitable durable material such as a metal (i.e. steel) or plastic (i.e. polypropylene), and which portions are axially interengaged and joined such as by heat welding, melting, gluing, or the like. The drum portions provide the drum with front and rear walls 22*a* and 24*a*, respectively; front wall 22*a* is provided with an opening, not designated numerically, which is coaxial with axis A and through which drum support tube 26, which is coaxial with axis A, is suitably secured to the front wall. Drum support 16 is constructed of a suitable material such as a metal (i.e. steel) or plastic (i.e. polypropylene) and includes a tubular body portion 28 at the upper end thereof which provides a passageway, not designated numerically, through which drum support tube 26 extends toward front end 18 of the support. The passageway interengages with tube 26 to support drum 14 for rotation about axis A, and the front end of drum support tube 26 is suitably interengaged with portion 28 of the drum support against axial separation of the drum therefrom, such as by a retaining ring, not designated numerically.

Drum support 16 further includes a pistol-type hand grip 40 integral with and extending downwardly from the upper tubular body portion 28 of the support intermediate front and rear ends 18 and 20 of the support. Drain cleaning cable C, as is conventional, is an elongate, flexible member made of tightly wound spring wire, and the cable is coiled in drum 14 about axis A and has an inner end in the drum. The free or outer end of the cable extends through drum support tube 26 and outwardly beyond front end 18 of the drum support and, in the embodiment illustrated, the outermost end of the cable is formed to provide an auger tip 38.

In accordance with the present invention, feed device 12 is mounted on front end 18 of drum support 16 and, in the embodiment illustrated in FIG. 1, comprises a cable driving roll 42 mounted on the lower side of the tubular body portion 28 of the drum support at front end 18, and a pair of actuator rolls 44 and 46 mounted on an actuator arm 48 of the feed device for radially engaging and displacing cable C against driving roll 42 to feed cable C axially inwardly or outwardly relative to drum 14. Preferably, actuator arm 48 is constructed of a suitable metal (i.e. steel) or plastic (i.e. polypropylene) and includes a circular skirt portion 50 extending axially of and circumferentially about front end 18 of the drum support, and a front wall 52 extending downwardly across the outermost end of the drum support transverse to axis A. Drive roll 42 is mounted on drum support 16 by a cap screw 54, and actuator rolls 44 and 46 are mounted on front wall 52 of actuator arm 48 by cap screws 56 and 58, respectively. Cap screws 54, 56 and 58 provide axes of rotation for the corresponding roll, and each roll axis is skewed both horizontally and vertically relative to drum axis A and, preferably, at an angle of about 25–45° with respect to each direction. The driving and actuator rolls have smooth outer surfaces, and the skewed mounting thereof provides for driving snake C axially when the snake is rotated and displaced against driving roll 42 as set forth more fully hereinafter.

Actuator arm 48 is mounted on the front end of tubular body portion 28 of support 16 for pivotal displacement in opposite directions about an arm axis transverse to and below drum axis A. For this purpose, the lower side of tubular body portion 28 is provided with a mounting lug, not shown, which extends downwardly between laterally spaced apart mounting ears, not shown, on the lower axially inner end of skirt 50 of the actuator arm. The lug and ears are pivotally interconnected by a pin 64 which provides the arm axis. Further, actuator arm 48 is provided with a trigger 66 which extends downwardly from mounting the ears axially forwardly adjacent hand grip 40 whereby, with regard to the orientation of the parts in FIG. 1, a finger or fingers of the hand of a person supporting the drum by holding hand grip 40 can pivot actuator arm 48 counterclockwise about the pin to displace actuator rolls 44 and 46 radially inwardly against cable C so as to displace the latter against drive roll 42. When actuator arm 48 is so displaced and the user of the tool causes the cable drum 14 to rotate about axis A by use of a crank arm or power operated drive, cable C is axially displaced inwardly or outwardly relative to drum 14 depending on the direction of rotation of the latter.

Generally, the drain cleaning cable is advanced axially forwardly of drum 14 in response to clockwise rotation of the latter and is retracted into the drum in response to counterclockwise rotation of the drum. Accordingly, it will be appreciated that a user of the tool can quickly and easily advance the cable into a drain to be cleaned without having to physically pull a length of cable from the drum and manually push the cable into the drain and that, advantageously, the cable is continuously rotated as it advances axially into the drain. This promotes axial movement of the cable around sharp bends and across drain joints whereas, with manually operated drain cleaning devices heretofore available, such movement required the operator to manually grasp the cable and reciprocate the latter in axially opposite directions in an effort to move the free end of the cable around bends and past drain joints. If an obstruction is encountered which stops or impedes axial advancement of the free end of the snake and the drain, the user can release trigger 66 and continue rotation of the cable until the obstruction is dislodged or penetrated by the cable. While a spring could be associated with actuator arm 48 for biasing the arm and thus actuator rolls 44 and 46 radially outwardly of axis A to the operative position thereof, such biasing is not necessary in view of the lightweight construction of the actuator arm and thus minimal wearing interengagement of the drive and actuator rolls with cable C when the actuator arm is in its released or inoperative condition.

As can be appreciated, the drain cleaning tool can include a drum support member, not shown, and a cable feed device, not shown, mounted on the front end of the drum support member and which is selectively operable to feed drain cleaning cable C axially relative to drum 14. The design and operation of such an arrangement is disclosed in U.S. Pat. No. 6,158,076 which is incorporated herein by reference.

Figure 5:
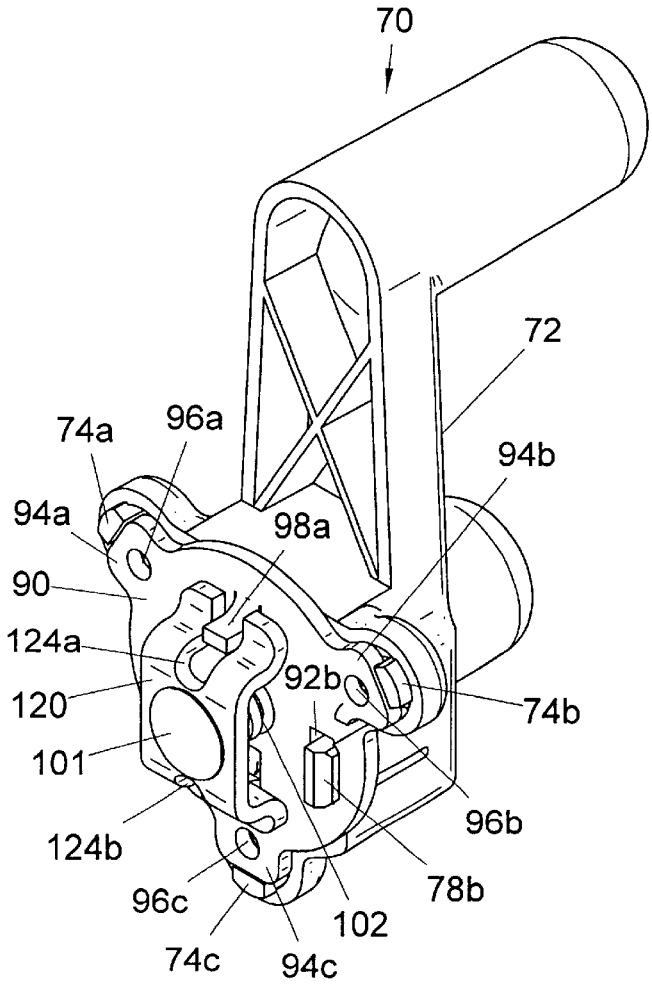
FIG. 5 is a perspective view of the manual handle connected to the vibration dampening arrangement in FIG. 4.
Figure 6:
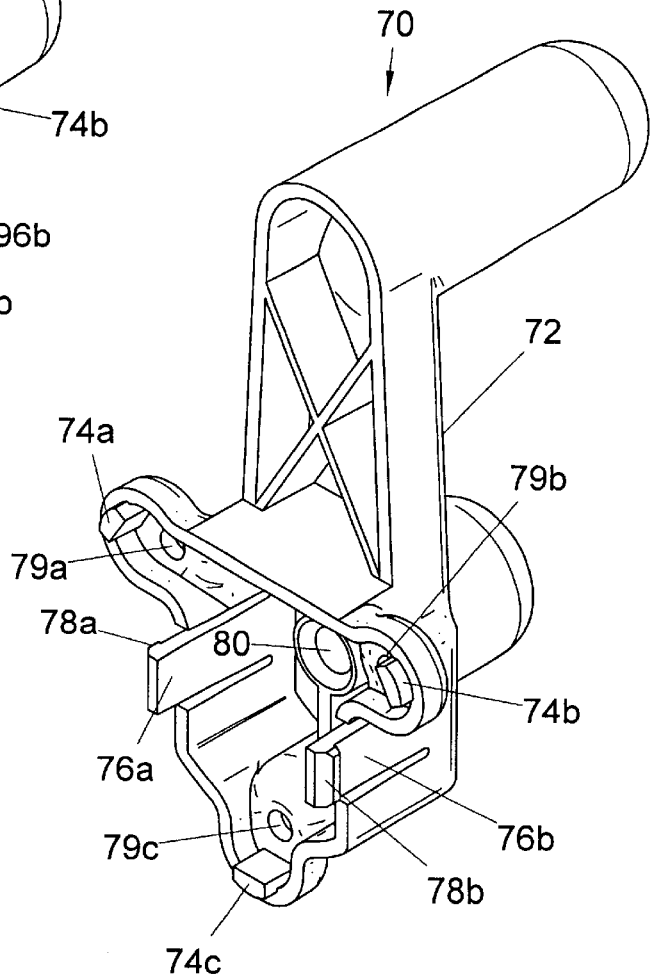
FIG. 6 is a perspective view of the manual handle disconnected from the vibration dampening arrangement.

Rear wall 24*a* of the drum is provided with a crank arm 70 substantially aligned with axis A to rotate drum 14 about axis A relative to drum support 16. Crank arm 70 includes a handle member 72 to allow an operator to manually grasp the crank arm during the manual rotation of drum 14. As best shown in FIG. 6, crank arm 70 also includes three positioning tabs 74*a*, 74*b*, 74*c* triangularly oriented on the inner surface. The three positioning tabs orient the crank arm on. crank mount 90. Crank arm 70 further includes two lock arms 76*a*, 76*b* which each have a lock nub 78*a*, 78*b* which are releasably securable to crank mount 90. The lock nubs allow the crank arm to be easily attached and detached from crank mount 90. Crank arm 70 also includes an opening 80 substantially aligned with axis A. Opening 80 is designed to receive one end of drive rod 100 when crank arm 70 is connected to crank mount 90. Opening 80, in combination with positioning tabs 74*a*, 74*b*, 74*c*, function to orient crank arm 70 on crank mount 90, while lock arms 76*a*, 76*b* releasably secure orient crank arm 70 to crank mount 90 as shown in FIG. 5. Although not shown, opening 80 can be designed to a) enable drive rod 100 to fully pass through crank arm 70 to provide access to the end of drive rod 100 to enable another device, such as a power operated drive, to be connected to the drive rod while the crank arm is connected to the crank mount, b) provide access to the end of drive rod 100 which end does not fully pass through the opening so as to enable another device, such as a power operated drive, to be connected to the drive rod while the crank arm is connected to the crank mount, or c) enclose the end of the drive rod in the crank arm.

Figure 3:
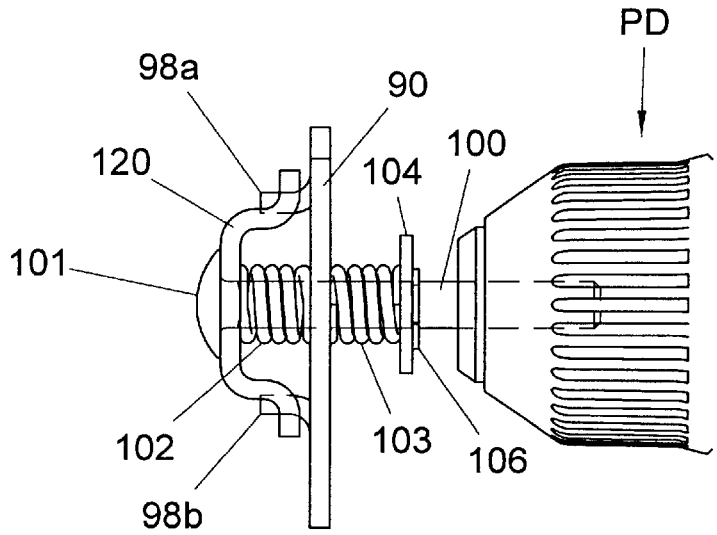
FIG. 3 is a sectional side view of the vibration dampening arrangement used in conjunction with a power drill.

Referring now to FIGS. 1–5, a vibration damper 110 is positioned on both sides of crank mount 90. Vibration damper 110 isolates the vibration caused from the rotation of the drum thereby reducing the amount of vibration transferred to the crank arm or other device connected to the drive rod. Vibration damper 110 includes two coil springs 102, 103 which are positioned about drive rod 100. Coil spring 102 is positioned in a semi-compressed position between crank mount 90 and position bracket 120, as shown in FIG. 3. Coil spring 103 is positioned in a semi compressed position between crank mount 90 and retaining washer 104, as shown in FIG. 3.

Figure 4:
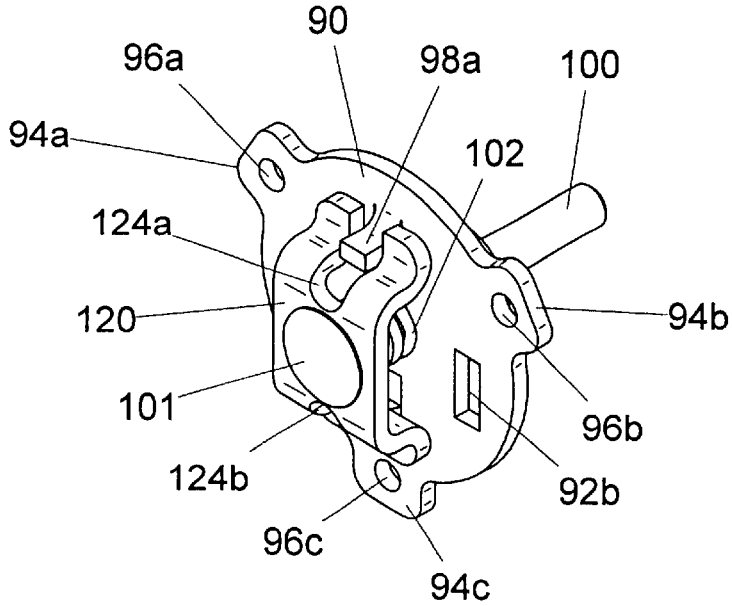
FIG. 4 is a rear elevation view of the assembled vibration dampening arrangement in FIG. 3.

The assembly of the drive rod and vibration damper is best shown in FIGS. 1 and 3. The head 101 of drive rod 100 is connected to drum 14. The head of drive rod 100 can be connected to drum 14 in any number of ways such as, but not limited to, welding, threaded screw, clamping, etc. Drive rod 100 is aligned along axis A to cause drum 14 to rotate about axis A when drive rod 100 is rotated. Position bracket 120 is inserted onto drive rod 100 by passing the end of the drive rod through opening 122 of position bracket 120. Opening 122 is shown to have a substantially square shape. The square-shape is designed to be non-rotatably inserted about a square shaped region near the head of drive rod 100, not shown, and sized small enough to not pass over head 101. When position bracket 120 is rotated about axis A, the position bracket causes drive rod 100 to also rotate about axis A due to the square shaped region on drive rod 100 and the corresponding square shaped opening 122. As can be appreciated, other shapes of opening 122 and the region on drive rod 100 can be used. As fiber can be appreciated, the shape of the drive rod and opening 122 can be such that position bracket 120 can rotate about drive rod 100 without causing drive rod 100 to rotate. Coil spring 102 is inserted onto drive rod 100 followed by crank mount 90. As shown in FIG. 1, crank mount 90 includes two side slots 92*a*, 92*b*, three tabs 94*a*, 94*b*, 94*c*, which each include an opening 96*a*, 96*b*, 96*c*, a central opening 97, and two guide tabs 98*a*, 98*b*. Central opening 97 is designed to allow the end of drive rod 100 to pass through crank mount 90. Crank mount 90 is moved toward position bracket 120 to cause coil spring 102 to be in a compressed state between the crank mount and the position bracket as shown in FIGS. 3, 4 and 5. The crank mount is positioned relative to position bracket 120 such that guide tabs 98*a*, 98*b* are inserted into slots 124*a*, 124*b*, respectively, as shown in FIGS. 3 and 4. Slots 124*a*, 124*b* allow crank mount 90 to move slightly along axis A while still maintaining engagement with position bracket 120. Three screws 99*a*, 99*b*, 99*c* are inserted through openings 96*a*, 96*b*, 96*c*, respectively, and then into three corresponding openings in rear wall 24*a* of drum 14. The three screws secure crank mount 90 to the rear wall of the drum as shown in FIG. 2. Coil spring 103 is then inserted onto the end of drive rod 100 followed by washer 104 and lock ring 106. Lock ring 106 is designed to be inserted into lock slot 105 in drive rod 100 to maintain coil spring 103 in a compressed state between crank mount 90 and washer 104 as shown in FIGS. 2 and 3. Typically, coil springs 102, 103 are maintained in a semi-compressed state.

Referring now to FIGS. 5 and 6, crank arm 70 is releasably connected to crank mount 90 by positioning the three positioning tabs 74*a*, 74*b*, 74*c* about tabs 94*a*, 94*b*, 94*c* on crank mount 90 and inserting two lock nubs 78*a*, 78*b* on lock arms 76*a*, 76*b* into side slots 92*a*, 92*b*. Crank arm 90 can be simply removed from crank mount 90 by depressing the two lock nubs 78*a*, 78*b* on lock arms 76*a*, 76*b* and then withdrawing the crank arm 70 from the crank mount 90. The crank arm 70 can be more permanently affixed to crank mount 90 by inserting the three screws 99*a*, 99*b*, 99*c* through openings 79*a*, 79*b*, 79*c* in crank arm 70, and then through openings 96*a*, 96*b*, 96*c* in crank mount 90. If the crank arm is to be later removed, the three screws must be removed prior to depressing the two lock nubs 78*a*, 78*b* on lock arms 76*a*, 76*b*.

Referring now to FIG. 3, a power operated drive PD is shown to be connected to the end of drive rod 100. The power operated drive is typically an electric power drill. As shown in FIG. 3, crank arm 70 is removed prior to connecting the power operated drive to the drive arm. As can be appreciated, the crank arm can be designed such that the power operated drive can be connected to the drive rod while the crank arm is still attached to the crank mount. When the power operated drive is used to rotate the drum, the vibration dampener 110 isolates much of the vibration caused by the rotating drum and cable C, thereby reducing the amount of vibration transferred to the power operated drive during use. As a result, the power operated drive can be operated at higher speeds.

While considerable emphasis has been placed herein on the structures and structural interrelationships between the component parts of the embodiments disclosed, it will be appreciated that other embodiments of the invention can be made and that many changes can be made in the embodiments illustrated and described without departing from the principles of the invention. Accordingly, it is to be distinctly understood that the foregoing descriptive matter is to be interrupted merely as illustrative of the present invention and not as a limitation thereof.

Having thus described the invention, it is so claimed:

1. In a handheld drain cleaning tool comprising a rotatable cable drum having a drum axis, a drain cleaning cable coiled in said drum for rotation therewith and having an end for extending from said drum and into a drain to be cleaned, a drum support supporting said drum for rotation about said drum axis and enabling a user to support said drum in one hand while the drum is rotated, and a drive coupling on said drum for receiving a drive mechanism for rotating said drum, the improvement comprising: said drive coupling including a drive rod coaxial with said drum axis and mountable such that it is movable in relation to said drum, and a vibration damping arrangement between said drum and said drive rod to reduce vibration between said drum and a drum drive mechanism connected to said drive rod.

2. A drain cleaning tool according to claim 1, wherein said vibration damping arrangement includes a mounting plate and at least one resilient member interposed between said mounting plate and said drive rod.

3. A drain cleaning tool according to claim 2, wherein said at least one resilient member is a spring.

4. A drain cleaning tool according to claim 2, wherein said rod extends through said plate and said at least one resilient member includes a resilient member on each of the axially opposite sides of said plate.

5. A drain cleaning tool according to claim 4, wherein each said resilient member is coaxial with said rod.

6. A drain cleaning tool according to claim 5, wherein each said resilient member is a coil spring.

7. A drain cleaning tool according to claim 1, wherein said vibration damping arrangement includes a mounting plate and said drive rod extends through said plate, and a drive plate interconnected with said mounting plate and said drive rod for rotation of said drive rod to rotate said drum.

8. A drain cleaning tool according to claim 7, and a resilient member between said mounting plate and said drive plate.

9. A drain cleaning tool according to claim 8, wherein said drive plate is on one side of said mounting plate and said resilient member is a first resilient member, and a second resilient member on the other side of the mounting plate.

10. A drain cleaning tool according to claim 9, wherein said first and second resilient members are compressed relative to said mounting plate.

11. A drain cleaning tool according to claim 10, wherein each said first and second resilient member is a coil spring coaxial with said drive rod.

12. A drain cleaning tool according to claim 11, wherein said drive plate and said mounting plate are axially displaceable relative to said drive rod and relative to one another.

13. A drain cleaning tool according to claim 1, wherein said vibration damping arrangement includes a mounting plate, and a crank for manually rotating said drum, said crank being removably mountable on said mounting plate independent of said drive rod.

14. A drain cleaning tool according to claim 13, wherein said mounting plate includes a plurality of crank mounting openings therethrough, and said crank includes a plurality of mounting arms each interengaging with a different one of said mounting holes.

15. A drain cleaning tool according to claim 14, wherein each of said mounting arms is resilient and includes a locking end extending through the corresponding mounting opening from one side of the mounting plate and engaging against the other side of the mounting plate.

16. A drain cleaning tool according to claim 14, wherein said mounting plate further includes positioning openings therethrough and said crank includes positioning tabs interengaging with said positioning openings to interengage said plate and crank against relative rotation therebetween.

17. A drain cleaning tool according to claim 16, wherein each of said mounting arms is resilient and includes a locking end extending through the corresponding mounting opening from one side of the mounting plate and engaging against the other side of the mounting plate.

18. A drain cleaning tool according to claim 14, wherein said vibration damping arrangement includes a mounting plate and said drive rod extends through said plate, and a drive plate interconnected with said mounting plate and said drive rod for rotation of said drive rod to rotate said drum.

19. A drain cleaning tool according to claim 18, wherein said drive plate is on one side of said mounting plate, a first resilient member compressed between said drive plate and said mounting plate, and a second resilient member compressed against the other side of the mounting plate.

20. A drain cleaning tool according to claim 19, wherein said drive plate and said mounting plate are axially displaceable relative to said drive rod and relative to one another.

21. A drain cleaning tool according to claim 20, wherein each of said mounting arms is, resilient and includes a locking end extending through the corresponding mounting opening from one side of the mounting plate and engaging against the other side of the mounting plate.

22. A drain cleaning tool according to claim 21, wherein said mounting plate further includes positioning openings therethrough and said crank includes positioning tabs interengaging with said positioning openings to interengage said plate and crank against relative rotation therebetween.

23. In a handheld drain cleaning tool comprising a rotatable cable drum having a drum axis, a drain cleaning cable coiled in said drum for rotation therewith and having an end for extending from said drum and into a drain to be cleaned, a drum support supporting said drum for rotation about said drum axis and enabling a user to support said drum in one hand while the drum is rotated, and a drive coupling on said drum for receiving a drive mechanism for rotating the drum, the improvement comprising: said drive coupling including a mounting plate on said drum, said drive mechanism including a manually operable crank, and said crank and mounting plate including snap locking interengaging components for releasably mounting said crank on said drum.

24. A drain cleaning tool according to claim 23, wherein said mounting plate includes a plurality of crank mounting openings therethrough, and said crank includes a plurality of mounting arms each interengaging with a different one of said mounting holes.

25. A drain cleaning tool according to claim 24, wherein each of said mounting arms is resilient and includes a locking end extending through the corresponding mounting opening from one side of them mounting plate and engaging against the other side of the mounting plate.

26. A drain cleaning tool according to claim 24, wherein said mounting plate further includes positioning openings therethrough and said crank includes positioning tabs interengaging with said positioning openings to interengage said plate and crank against relative rotation therebetween.

27. A drain cleaning tool according to claim 26, wherein each of said mounting arms is resilient and includes a locking end extending through the corresponding mounting opening from one side of the mounting plate and engaging against the other side of the mounting plate.

* * * * *

UNITED STATES PATENT AND TRADEMARK OFFICE

CERTIFICATE OF CORRECTION

PATENT NO. : 6,615,436 B1
DATED : September 9, 2003
INVENTOR(S) : Burch, Jr. et al.

It is certified that error appears in the above-identified patent and that said Letters Patent is hereby corrected as shown below:

Title page,
Item [*] Notice, change "0" to -- 459 --.

Column 3,
Line 43, insert a period after the second appearance of "drive"; and
Line 51, delete the period following the first appearance of "to".

Column 6,
Line 63, delete "the" and after "from" insert -- the --.

Column 7,
Line 49, delete the period after "on"; and
Line 60, after "secure" introduce -- and --.

Column 8,
Line 35, change "fiber" to -- further --.

Column 10,
Line 57, delete the comma after "is."

Column 12,
Line 4, change "them" to -- the --.

Signed and Sealed this

Twenty-third Day of December, 2003

JAMES E. ROGAN
*Director of the United States Patent and Trademark Office*